US008020385B2

(12) United States Patent
Popovic et al.

(10) Patent No.: US 8,020,385 B2
(45) **Date of Patent: *Sep. 20, 2011**

(54) CENTERBODY CAP FOR A TURBOMACHINE COMBUSTOR AND METHOD

(75) Inventors: Predrag Popovic, Simpsonville, SC (US); William Kirk Hessler, Greer, SC (US); Krishna Kumar Venkataraman, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 678 days.

This patent is subject to a terminal disclaimer.

(21) Appl. No.: 12/180,879

(22) Filed: Jul. 28, 2008

(65) Prior Publication Data

US 2010/0018181 A1 Jan. 28, 2010

(51) Int. Cl.
*F02C 1/00* (2006.01)

(52) U.S. Cl. ..... 60/752; 165/169

(58) Field of Classification Search ..... 60/804, 60/747, 740, 746, 737, 733, 722, 752; 165/169, 165/156, 147; 431/10, 351, 353
See application file for complete search history.

(56) References Cited

U.S. PATENT DOCUMENTS

| | | | | |
|---|---|---|---|---|
| 4,374,637 | A * | 2/1983 | Zwick et al. | 431/183 |
| 5,025,622 | A * | 6/1991 | Melconian | 60/39.464 |
| 5,125,227 | A | 6/1992 | Ford et al. | |
| 5,253,478 | A | 10/1993 | Thibault, Jr. et al. | |
| 6,910,336 | B2 | 6/2005 | Sullivan et al. | |
| 6,951,109 | B2 | 10/2005 | Lemon et al. | |
| 7,614,234 | B2 * | 11/2009 | Cazalens et al. | 60/746 |
| 7,921,653 | B2 * | 4/2011 | Som et al. | 60/782 |
| 2010/0043441 | A1 * | 2/2010 | Hessler et al. | 60/752 |
| 2010/0077762 | A1 * | 4/2010 | Hessler et al. | 60/752 |
| 2010/0107645 | A1 * | 5/2010 | Kollati | 60/752 |

* cited by examiner

*Primary Examiner* — Ehud Gartenberg
*Assistant Examiner* — Vikansha Dwivedi
(74) *Attorney, Agent, or Firm* — Cantor Colburn LLP

(57) ABSTRACT

A turbomachine includes a combustor assembly, a cap assembly attached to the combustor assembly, a centerbody within the cap assembly, a wall of the centerbody having a first end, a second end and an intermediate portion, and an external turbulator member in operable communication with the cap assembly. The external turbulator member is spaced from the wall to form a passage defined by a gap between the wall of the centerbody and the external turbulator. The external turbulator member includes a step positioned at the second end of the centerbody. The step defines a radial distance about the second end of the centerbody. The external turbulator member is formed having a step-to-gap ratio relative to the centerbody in a range of about 0.8 to about 1.2.

10 Claims, 3 Drawing Sheets

CENTERBODY CAP FOR A TURBOMACHINE COMBUSTOR AND METHOD

BACKGROUND OF THE INVENTION

Exemplary embodiments of the present invention relate to the art of turbomachines and, more particularly, to a center body cap for a turbomachine combustor liner.

Gas turbomachines include a compressor for compressing air, a combustor and a turbine. The combustor mixes the compressed air and a fuel to form a combustible mixture that is ignited to produce hot gases. The hot gases are passed to the turbine to produce work. The hot gases then pass from the turbomachine through an exhaust system. The hot gases passing through the exhaust may include undesirable oxides of nitrogen (NOx) and carbon monoxide (CO). In order to reduce the undesirable pollutants, conventional turbomachines employ dry low NOx (DLN) combustors that reduce the generation of NOx and CO and other pollutants. DLN combustors accommodate lean fuel mixtures while avoiding unstable flames and flame blowouts by allowing a portion of flame zone air to mix with fuel at lower loads.

BRIEF DESCRIPTION OF THE INVENTION

In accordance with an exemplary embodiment of the invention, a turbomachine includes a combustor assembly, a cap assembly attached to the combustor assembly, a centerbody within the cap assembly, a wall of the centerbody having a first end, a second end and an intermediate portion, and an external turbulator member in operable communication with the cap assembly. The external turbulator member is spaced from the wall to form a passage defined by a gap between the wall of the centerbody and the external turbulator. The external turbulator member includes a step positioned at the second end of the centerbody. The step defines a radial distance about the second end of the centerbody. The external turbulator member is formed having a step-to-gap ratio relative to the centerbody in a range of about 0.8 to about 1.2.

In accordance with another exemplary embodiment of the invention, a cap assembly for a turbomachine includes a centerbody within the cap assembly, a wall of the centerbody having a first end, a second end and an intermediate portion, and an external turbulator member in operable communication with the cap assembly. The external turbulator member is spaced from the wall to form a passage defined by a gap between the wall of the centerbody and the external turbulator member. The external turbulator member includes a step positioned at the second end of the centerbody. The step defines a radial distance about the second end of the centerbody. The external turbulator member is formed having a step-to-gap ratio relative to the centerbody in a range of about 0.8 to about 1.2.

In accordance with still another exemplary embodiment of the invention, a method for controlling emissions and enhancing flame stability in a turbomachine combustor includes passing a fluid through a cap assembly centerbody of the combustor with the centerbody including a wall, and guiding a cooling airflow through a passage defined by a gap extending between the wall of the centerbody and a turbulator member having a step portion. The turbulator member is formed having a step-to-gap ratio relative to the centerbody of between about 0.8 and about 1.2. The step-to-gap ratio enhances air/fuel mixing and reduces an amount of the cooling airflow required by the combustor.

DETAILED DESCRIPTION OF THE INVENTION

Figure 1:
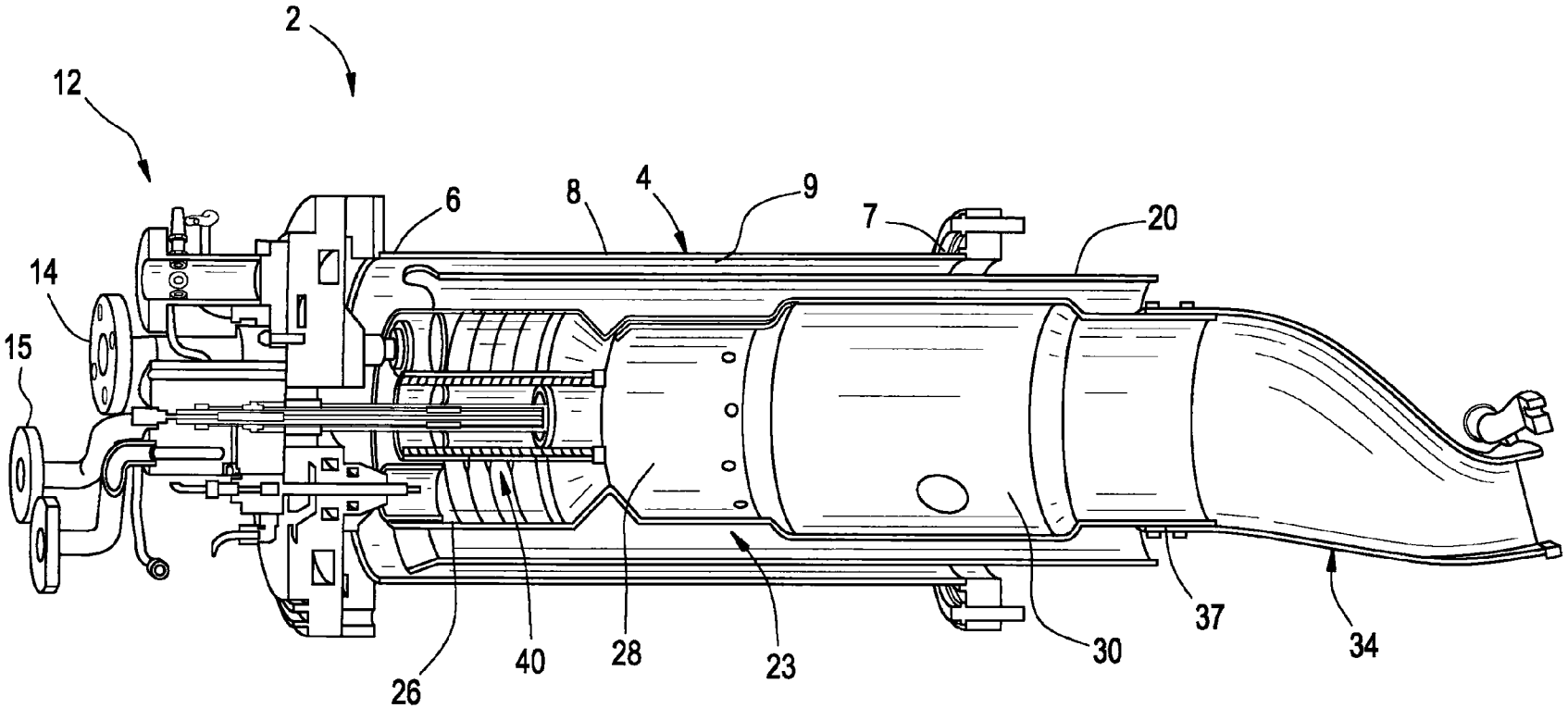
FIG. 1 is a cross-sectional side view of a turbomachine combustor assembly including a centerbody cap in accordance with exemplary embodiments of the invention.

Referring to FIG. 1, a turbomachine combustor assembly constructed in accordance with exemplary embodiments of the invention is indicated generally at 2. Combustor assembly 2 includes an outer casing 4 having a first end portion 6 that extends to a second end portion 7 through an intermediate portion 8 that collectively define an interior portion 9. Combustor assembly 2 is also shown to include an end cover assembly 12 arranged at first end portion 6 of outer casing 4. End cover assembly 12 is shown to include a primary nozzle 14 and a secondary nozzle 15. Fuel is introduced through end cover assembly 12, mixed with air and ignited to form high temperature/high pressure gases that are utilized to drive a turbine (not shown). Towards that end, combustor assembly 2 includes a flow sleeve 20 that extends within interior portion 9 and houses a liner assembly 23.

As shown, liner assembly 23 includes a head end section 26 that extends to a venturi section 28 to an end liner portion 30. End liner portion 30 is coupled to a transition piece 34 via a hula seal assembly 37. A cap assembly 40 extends from end cover assembly 12, through head end section 26 toward venturi section 28. Fuel and air are introduced into cap assembly 40 and head end 26, mixed and delivered into venturi section 28 where the fuel/air mixture is ignited to form high temperature/high pressure gases that pass to end liner portion 30, through transition piece 34 and toward a first stage of a turbine (not shown).

Figure 2:
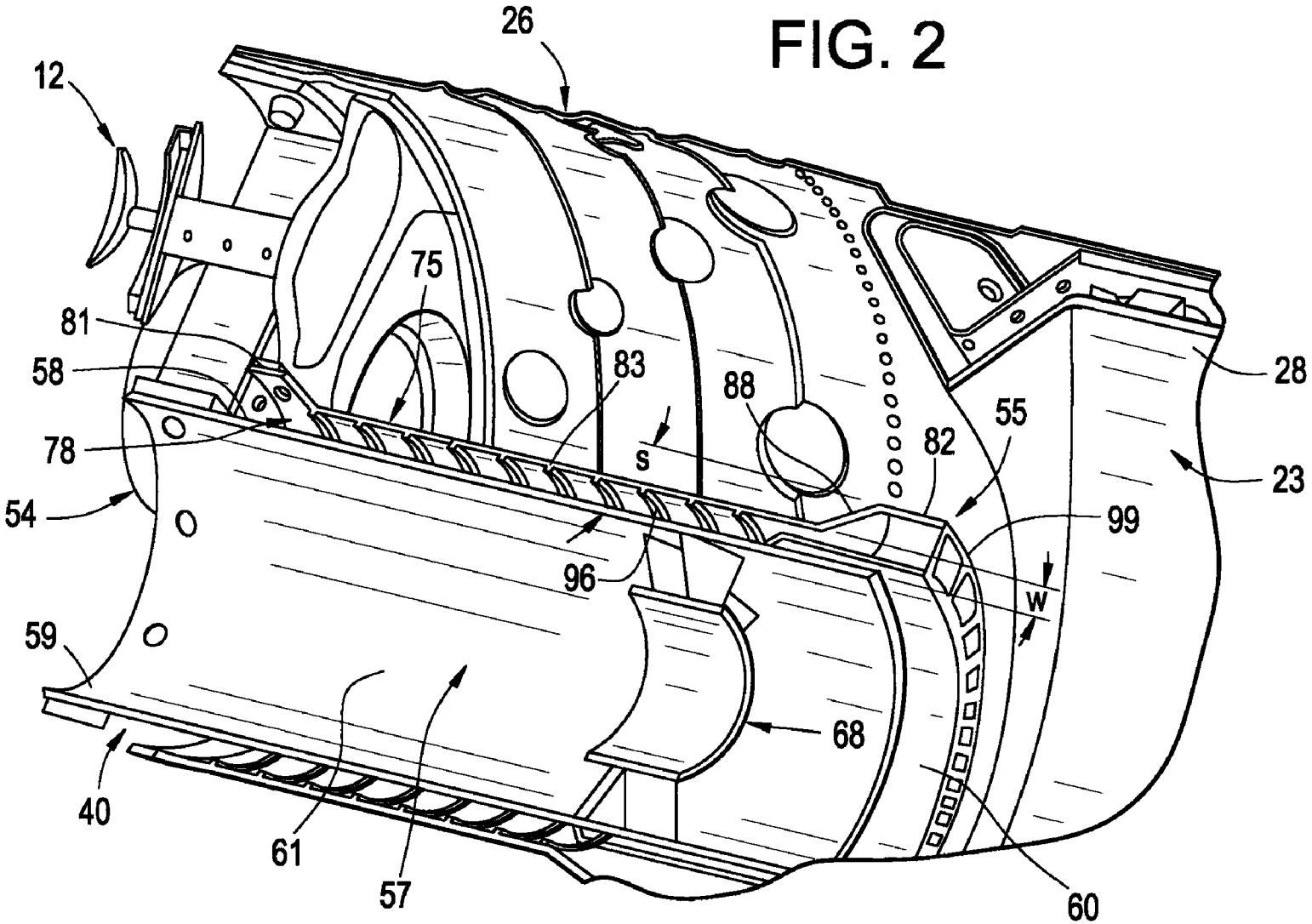
FIG. 2 is a cross-sectional side view of the centerbody cap assembly of FIG. 1.
Figure 3:
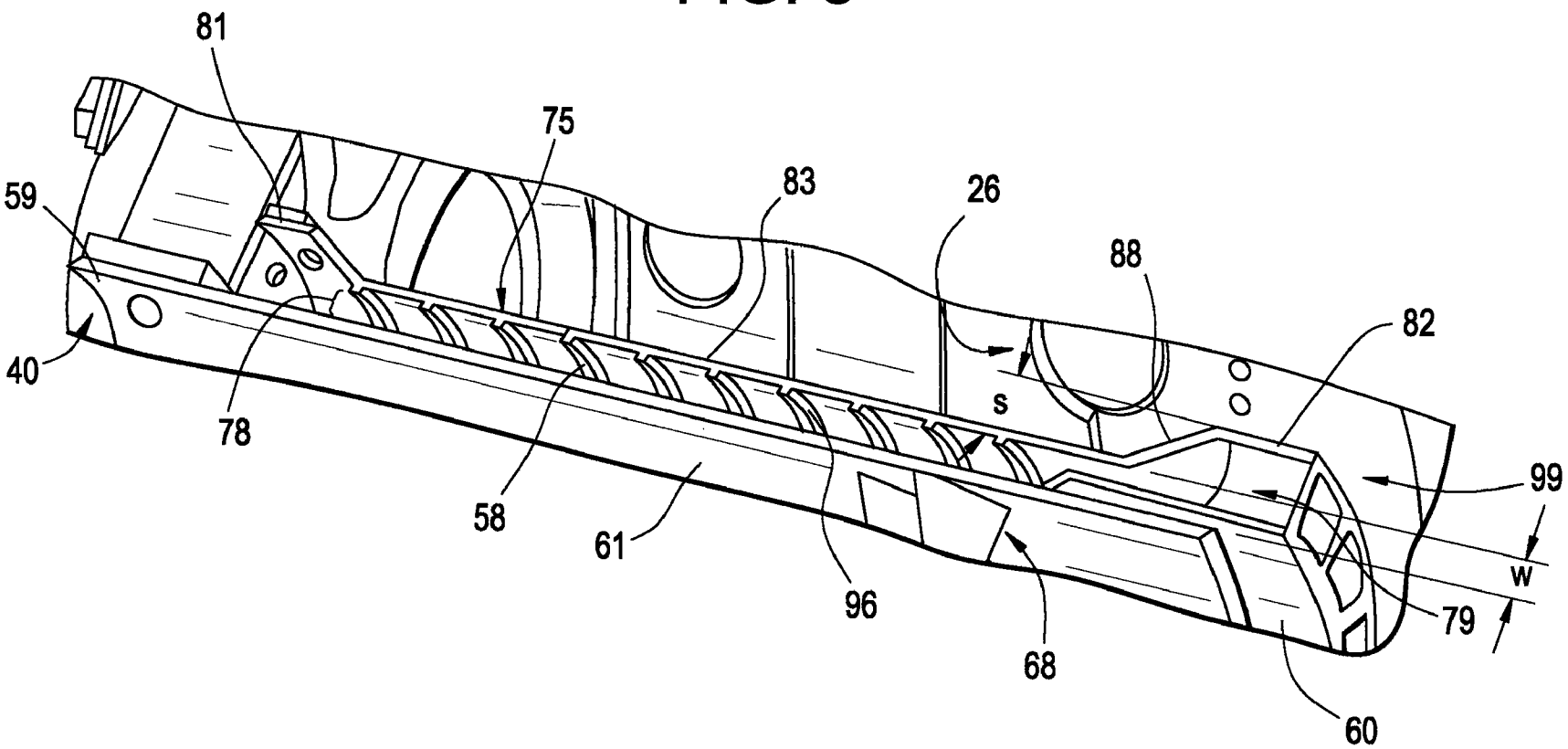
FIG. 3 is a detail view of an external turbulator portion of the centerbody cap assembly of FIG. 2.

As best shown in FIGS. 2 and 3 cap assembly 40 includes a centerbody 54 and a cap 55. Cap assembly 40 is mounted to head end section 26 and protects secondary nozzle assembly 15. As will be discussed more fully below, cap assembly 40 also shrouds cooling air necessary for cooling centerbody 54. As shown, centerbody 54 includes a wall 57 having an outer surface 58 that extends from a first end 59 to a second end 60 through an intermediate portion 61 defining an internal passage 65. In the exemplary embodiment shown, internal passage 65 has a diameter of about 3-inches (7.62-cm). However, it should be understood that the diameter of internal passage 65 can vary in accordance with exemplary embodiments of the invention. An inner swirler or turbulator 68 is arranged within internal passage 65 near second end 60. Inner turbulator 68 imparts a swirling effect to the fuel/air mixture to enhance mixing.

In further accordance with the exemplary embodiment shown, cap assembly 40 includes an external turbulator member 75 that encapsulates centerbody 54 extending along wall 57 from first end 59 towards second end 60. More specifically, external turbulator member 75 is mounted to, yet spaced from, cap assembly 40 so as to define a gap or passage 78 having a width "w". Cooling air passes along passage 78 before exiting cap 55. External turbulator member 75 includes a first end section 81 extending to a second end section 82 through an intermediate section 83. A step 88 having a height "s" is arranged at second end section 82. That is step 88 defines a radial distance "s" between section end section 82 and intermediate section 83. In any event, in accordance with one exemplary aspect of the invention, width "w" and radial distance "s" are sized so that external turbulator 75 includes a step-to-gap ratio ("s"/"w") in a range of about 0.8 to about 1.2. Of course, it should be understood that the particular step-gap-ratio range can vary depending upon turbomachine size and/or rating. In accordance with another exemplary aspect of the invention, width "w" and radial distance "s" are sized so that external turbulator 75 includes a step-to-gap ratio in a range of about 0.9 to about 1.1. In accordance with yet another exemplary aspect of the invention, width "w" and radial distance "s" are sized so that external turbulator has a step-to-gap ratio of about 1.0.

In addition, external turbulator member 75 includes a plurality of cooling ribs 96 that extend circumferentially about centerbody 54, and a turbulator portion 99 arranged at second end section 83. Cooling ribs 96 enhance heat transfer from external turbulator member 75. Moreover, the step-to-gap ratio, in accordance with the exemplary embodiments of the invention, reduces an amount of cooling airflow required. More specifically, the step enhances external mixing of a fuel air mixture passing over an external surface of the external turbulator while the gap reduces cooling air flow passing over the centerbody. That is, by sizing the step-to-gap ratio for a particular desired flow rate, turbomachine emissions are reduced and flame stability is increased. The combined reduction in emissions and increased flame stability enhances combustion efficiency, which results in overall efficiency improvements of the turbomachine. Reducing the amount of air/fuel passing over centerbody 54 by decreasing gap 78 and providing improved air/fuel mixing by increasing step 86 and/or 88 additional airflow is available for other components/systems in the turbomachine. This additional airflow enhances operational efficiencies for the turbomachine.

In general, this written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of exemplary embodiments of the present invention if they have structural elements that do not differ from the literal language of the claims, or if they include equivalent structural elements with insubstantial differences from the literal language of the claims.

The invention claimed is:

1. A turbomachine comprising:

a combustor assembly;

a cap assembly attached to the combustor assembly;

a centerbody within the cap assembly;

a wall of the centerbody having a first end, a second end and an intermediate portion; and an external turbulator member in operable communication with the cap assembly, the external turbulator member being spaced from the wall to form a passage defined by a gap between the wall of the centerbody and the external turbulator, the external turbulator member including:

a step positioned at the second end of the centerbody, the step defining a radial distance about the second end of the centerbody, wherein the external turbulator is formed having a step-to-gap ratio relative to the centerbody in a range of about 0.8 to about 1.2.

2. The turbomachine according to claim 1, wherein the external turbulator member includes a step-to-gap ratio in a range between about 0.9 and about 1.1.

3. The turbomachine according to claim 2, wherein the external turbulator member includes a step-to-gap ratio is about 1.0.

4. A cap assembly for a turbomachine, the cap assembly comprising:

a centerbody within the cap assembly;

a wall of the centerbody having a first end, a second end and an intermediate portion; and an external turbulator member in operable communication with the cap assembly, the external turbulator member being spaced from the wall to form a passage defined by a gap between the wall of the centerbody and the external turbulator member, the external turbulator member including:

a step positioned at the second end of the centerbody, the step defining a radial distance about the second end of the centerbody, wherein the external turbulator member is formed having a step-to-gap ratio relative to the centerbody in a range of about 0.8 to about 1.2.

5. The cap assembly according to claim 4, wherein the external turbulator member includes a step-to-gap ratio in a range between about 0.9 and about 1.1.

6. The cap assembly according to claim 5, wherein the external turbulator member includes a step-to-gap ratio is about 1.0.

7. A method for controlling emissions and enhancing flame stability in a turbomachine combustor, the method comprising:

passing a fluid through a cap assembly centerbody of the combustor, the centerbody including a wall; and guiding a cooling airflow through a passage defined by a gap extending between the wall of the centerbody and a turbulator member having a step portion, the turbulator member is formed having a step-to-gap ratio relative to the centerbody of between about 0.8 and about 1.2, the step-to-gap ratio enhancing air/fuel mixing and reducing an amount of the cooling airflow required by the combustor.

8. The method of claim 7, wherein guiding the cooling airflow through the passage comprises guiding the cooling airflow through a turbulator member configured with a step-to-gap ratio of between about 0.9 and about 1.1.

9. The method of claim 8, wherein guiding the cooling airflow through the passage comprises guiding the cooling airflow through a turbulator member configured with a step-to-gap ratio of about 1.0.

10. The method of claim 7, wherein enhancing air/fuel mixing and reducing an amount of the cooling airflow required by the combustor reduces emissions and increases flame stability.

* * * * *